US007552537B2

(12) United States Patent
Ye

(10) Patent No.: US 7,552,537 B2
(45) Date of Patent: Jun. 30, 2009

(54) UTILITY CUTTER

(76) Inventor: Jing Rong Ye, 8 Sheng Di Rd., Yuang Ind. Zone, Shen Jia Dian, Yuhang Town, Hangzhou 311121, Zhejiang (CN)

( * ) Notice: Subject to any disclaimer, the term of this patent is extended or adjusted under 35 U.S.C. 154(b) by 349 days.

(21) Appl. No.: 11/523,951

(22) Filed: Sep. 19, 2006

(65) Prior Publication Data

US 2008/0066318 A1 Mar. 20, 2008

(51) Int. Cl.
*B26B 1/02* (2006.01)

(52) U.S. Cl. ..... 30/161; 30/155; 30/156; 30/330

(58) Field of Classification Search ..... 30/153, 30/155, 156, 164, 161, 330, 331
See application file for complete search history.

(56) References Cited

U.S. PATENT DOCUMENTS 6,574,868 B1 * 6/2003 Overholt ..... 30/155
7,380,341 B2 * 6/2008 Ping ..... 30/161
2002/0162229 A1 * 11/2002 Roberts et al. ..... 30/330
2007/0169353 A1 * 7/2007 Wu ..... 30/155

* cited by examiner

*Primary Examiner*—Stephen Choi
(74) *Attorney, Agent, or Firm*—Raymond Y. Chan; David and Raymond Patent Firm

(57) ABSTRACT

A utility cutter includes a cutter blade, a cutter handle, a blade frame, and a blade replacement arrangement. The blade frame includes a first and a second frame member pivotally mounted with each other to define a blade receiving cavity that the cutter blade is substantially retained at the blade receiving cavity, wherein the blade frame is pivotally mounted to the elongated cutter handle for folding between a folded position and an unfolded position. The blade replacement arrangement is operatively coupled with the first and the second frame member for normally locking the first and the second frame member with each other. When the blade frame is in the unfolded position, the blade replacement arrangement is adapted to unlock the first frame member, such that the cutter blade is capable of being conveniently and safely replaced at the blade receiving cavity without sliding movement of the cutter blade.

5 Claims, 5 Drawing Sheets

UTILITY CUTTER

BACKGROUND OF THE PRESENT INVENTION

1. Field of Invention

The present invention relates to a cutter, and more particularly to a utility cutter comprising a blade replacement arrangement which allows convenient and safe replacement of cutter blades for the utility cutter.

2. Description of Related Arts

A conventional cutter for artistic cutting purposes usually comprises an elongated cutter body having a receiving cavity and a front opening communicating with the receiving cavity, a cutter blade having a sharp cutting portion for cutting an object, and an actuation arrangement coupled with the cutter body for actuating the cutter blade to move between a idle position and a cutting position, wherein in the cutting position, the cutter blade is driven by the actuation arrangement to receive in the receiving cavity, wherein in the cutting position, the actuation arrangement is drive to slidably push the sharp cutting portion of the cutter blade out of the receiving cavity via the front opening for cutting an object.

For this kind of conventional cutter, there exist several mechanisms by which a sharpness of the cutter blade is to be maintained so as to ensure that the cutter can discharge good cutting performance. For example, a plurality of cutting routes are spacedly formed on the cutter blade so that when the cutting portion is blunt, a user is able to conveniently break the cutter blade along the corresponding cutting route for replacing the old cutting portion with a new sharp cutting portion formed by breaking the cutter blade along the cutting route.

In order to replace the cutter blade, the conventional cutter usually further comprises a cover lid detachably mounted on a rear portion of the cutter body for detachably enclosing the receiving cavity. Thus, when a user wishes to replace the cutter blade, he or she has to detach the cover lid from the cutter body, remove the old cutter blade from the receiving cavity, and put a new cutter blade into the receiving cavity for allowing the new cutter blade to engage with the actuation arrangement.

There exist several problems with this kind of conventional utility cutter. First and foremost, in order to replace the cutter blade, the user has to open the cover lid and pull the cutter blade out from the receiving cavity. Very often, the cutter blade is engaged with the actuation arrangement so that the user has to pull out the actuation arrangement as well before he or she can remove the old cutter blade. Although the cutter blade would have been blunt at the time the replacement is performed, it is nevertheless sharp enough to easily hurt the user's hands, especially when the user has to touch the edge of the cutter blade in order to pull it out.

Second, since the operation of the conventional cutter depends much on the sliding actuation by the actuation arrangement, the cutter body is usually elongated in shape. In certain circumstances, the elongated shape of the cutter body brings inconvenience to the user. Moreover, the sliding motion of the cutter blade may be accidentally actuated by other objects so that the user may notice that the cutting portion of the cutter blade has already been pushed out of the cutter body. This may cause accidental injury to user's hands or to others who come into contact with the cutter.

As a matter of fact, there exist foldable knives in which the blades are capable of folding towards the corresponding handle frames so as to reduce the entire foldable knife into a compact structure. However, this kind of foldable knife is only meant for outdoor use and they are in no sense cutters as mentioned above.

SUMMARY OF THE PRESENT INVENTION

A main object of the present invention is to provide a utility cutter comprising a blade replacement arrangement which allows convenient and safe replacement of cutter blades for the utility cutter.

Another object of the present invention is to provide a utility cutter comprising a blade replacement arrangement, wherein replacement of cutter blade is accomplished by first disengaging a first and a second frame member of a blade frame, and then detaching the cutter blade directly therefrom without substantial sliding movement of the cutter blade. In other words, the shortcomings of the above-mentioned conventional cutters can be substantially resolved.

Another object of the present invention is to provide a utility cutter comprising a blade replacement arrangement, wherein replacement of the cutter blade is assisted by magnetic holding force exerted towards the cutter blade for preventing the cutter blade from accidental dropping from the blade frame. In other words, the present invention ensures that the maximum degree safety will be observed when the cutter blade is being replaced.

Another object of the present invention is to provide a utility cutter comprising a blade replacement arrangement, wherein the utility cutter is capable of folding into a compact size when it is not in use. As a result, the present invention is easy to carry and therefore suitable for use in different environments.

Accordingly, in order to accomplish the above objects, the present invention provides a utility cutter, comprising:

a cutter blade having a sharp edge and defining a sharp end thereat;

an elongated cutter handle;

a blade frame comprising a first and a second frame member pivotally mounted with each other to define a blade receiving cavity between the first and second frame members that the cutter blade is substantially retained at the blade receiving cavity, wherein the blade frame is pivotally mounted to the elongated cutter handle for folding between a folded position and an unfolded position, wherein in the folded position, the blade frame is pivotally folded to receive in the cutter handle to conceal the cutting blade, wherein in the unfolded position, the blade frame is pivotally unfolded to fully extend for exposing the sharp end of the cutter blade to an exterior of the blade frame; and a blade replacement arrangement operatively coupled with the first and the second frame member for normally locking the first and the second frame member with each other to securely lock up the cutter blade in the blade receiving cavity, wherein when the blade frame is in the unfolded position, the blade replacement arrangement is adapted to unlock the first frame member from the second frame member so as to allow the first frame member to disengage with the second frame member for exposing the blade receiving cavity to an exterior of the blade frame, such that the cutter blade is capable of being conveniently and safely replaced at the blade receiving cavity without sliding movement of the cutter blade.

These and other objectives, features, and advantages of the present invention will become apparent from the following detailed description, the accompanying drawings, and the appended claims.

DETAILED DESCRIPTION OF THE PREFERRED EMBODIMENT

Figure 1:
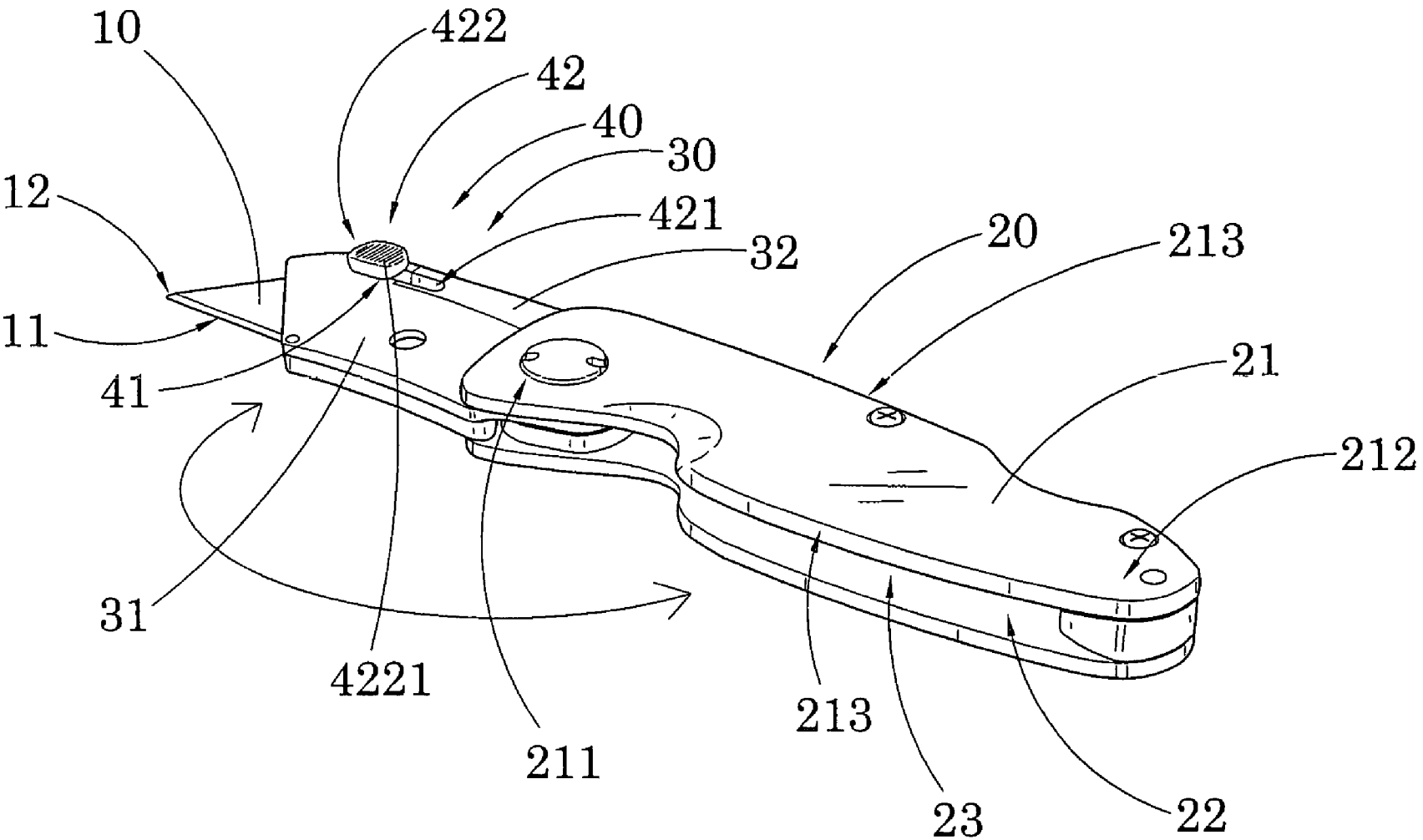
FIG. 1 is a perspective view of a utility cutter according to a preferred embodiment of the present invention.

Referring to FIG. 1, FIG. 2, FIG. 3, FIG. 4A and FIG. 4B of the drawings, a utility cutter according to a preferred embodiment of the present invention is illustrated, in which the utility cutter comprises a cutter blade 10 having a sharp edge 11 and defining a sharp end 12 thereat, an elongated cutter handle 20, a blade frame 30, and a blade replacement arrangement 40.

The blade frame 30 comprises a first and a second frame member 31, 32 pivotally mounted with each other to define a blade receiving cavity 33 between the first and second frame members 31, 32 that the cutter blade 10 is substantially retained at the blade receiving cavity 33, wherein the blade frame 30 is pivotally mounted to the elongated cutter handle 20 for folding between a folded position and an unfolded position, wherein in the folded position, the blade frame 30 is pivotally folded to receive in the cutter handle 20 to conceal the cutting blade 10, wherein in the unfolded position, the blade frame 30 is pivotally unfolded to fully extend for exposing the sharp end 12 of the cutter blade 10 to an exterior of the blade frame 30.

The blade replacement arrangement 30 is operatively coupled with the first and the second frame member 31, 32 for normally locking the first and the second frame member 31, 32 with each other to securely lock up the cutter blade 10 in the blade receiving cavity 33, wherein when the blade frame 30 is in the unfolded position, the blade replacement arrangement 40 is adapted to unlock the first frame member 31 from the second frame member 32 so as to allow the first frame member 31 to disengage with the second frame member 32 for exposing the blade receiving cavity 33 to an exterior of the blade frame 30, such that the cutter blade 10 is capable of being conveniently and safely replaced at the blade receiving cavity 33 without substantial sliding movement of the cutter blade 10.

According to the preferred embodiment of the present invention, the cutter blade 10 is meant to perform primarily artistic cutting work so that the utility cutter of the present invention, unlike foldable knives, is not primarily designed for use in, say, camping environment, wherein extensive cutting of various outdoor objects is required.

The elongated cutter handle 20 comprises an elongated handle housing 21 having a front and a rear end portions 211, 212 and two side edges 213 extending between the front and the rear end portion 211, 212, and has a blade cavity 22 formed in the handle housing 21, and an opening 23 formed along one of the two side edges of the handle housing for communicating with the blade cavity 22, wherein the blade frame 30 is adapted to be folded and received into the blade cavity 22 via the opening 23 when the blade frame 30 is in the folded position. Accordingly, a length of the handle housing 21 must be longer than that of the blade frame 30 so as to allow the blade frame 30 to be received into the blade cavity 22 for folding into a compact size.

On the other hand, the blade frame 30, having a thickness smaller than that of the handle housing 21, is pivotally mounted therewith to fold between the folded position and the unfolded position. More specifically, the blade frame 30 has an inner end portion received in the blade cavity 22 and pivotally connected with the front end portion 211 of the handle housing 21, and an outer end portion frontwardly extended from the handle housing 21, wherein the sharp end 12 of the cutter blade 10 is extended out of the outer end portion of the blade frame 30 for cutting an object when the blade frame 30 is in the unfolded position.

Referring to FIG. 2, FIG. 3, FIG. 4A and FIG. 4B of the drawings, the first frame member 31 comprises an upper supporting panel 311, and a bottom supporting panel 312 having a longitudinal portion and a transverse potion to define a L-shaped cross section, wherein the transverse portion of the bottom supporting panel 312 is integrally connected with an outer side edge portion of the upper supporting panel 311 to form a supporting groove 313 between the first and the second frame member 31, 32 as partially defining the blade receiving cavity 33 of the blade frame 30. In other words, when the first and the second frame member 31, 32 are interlocked with each other, part of the cutter blade 10 is arranged to receive in the space between the upper and the bottom supporting panel 311, 312 (i.e. part of the blade receiving cavity 33).

The second frame member 32, which is pivotally extended from the handle housing 21 of the cutter handle 20, has a L-shaped retaining groove 321 longitudinally extended along an inner side edge of the second frame member 32 to align with the supporting groove 313 of the first frame member 31 so that when the first frame member 31 is interlocked with the second frame member 32, the supporting groove 313 is communicated with the retaining groove 321 to form the blade receiving cavity 33 of the blade frame 30, wherein the cutter blade 10 is fittedly received into the blade receiving cavity 33 with two side edges substantially biasing against the respective side edges of the supporting groove 313 and the retaining groove 321 respectively.

The blade replacement arrangement 40 comprises a first and a second engaging device 41, 42 provided on the first and the second frame member 31, 32 respectively for detachably engaging the first frame member 31 with the second frame member 32. The first engaging device 41 comprises a locking latch member 411, having a U-shaped locker latch 4111, integrally and sidewardly extended from a front end portion of the upper supporting panel 311 of the first frame member 31 for detachably engaging with the second engaging device 42. It is worth mentioning that the U-shaped locker latch 4111 defines a locker channel 4112 at the locking latch member 411.

The second engaging device 42 contains a locking slot 421 longitudinally formed on the second frame member 32, and comprises a locking actuator 422 slidably mounted on the locking slot 421 for detachably engaging with the locking latch member 411 of the first engaging device 41. More specifically, the locking actuator 422 comprises a top and a bottom pusher button 4221, 4222 movably provided on a top and a bottom side of the locking slot 421 respectively, and a locker pin 4223 extended between the top and the bottom pusher buttons 4221, 4222 for slidably moving within the locking slot 421. In other words, when either the top pusher button 4221 or the bottom pusher button 4222 is driven to slide along the locking slot 421, the locker pin 4223 is also driven to slide along the locking slot 421 correspondingly.

According to the preferred embodiment of the present invention, the locker channel 4112 is arranged to align with the locking slot 421 such that when the first engaging device 41 is engaged with the second engaging device 42, the locking slot 421 and the locker channel 4112 overlap with each other for allowing the locking actuator 422 to slide along the locker channel 4112 and the locking slot 421. Thus, the blade replacement arrangement 40 is adapted to operate between a locked mode and an unlocked mode, wherein in the locked mode, the first engaging device 41 is arranged to pivotally move to engage with the second engaging device 42 and that the locker pin 4223 is driven (by a sliding movement of either the top or the bottom pusher buttons 4221, 4222) to slidably move frontwardly along the locking slot 421 to block a pivotal disengagement between the first engaging device 41 and the second engaging device 42. Conversely, when the blade replacement arrangement 40 is in the unlocked mode, the locker pin 4223 is driven to move rearwardly along the locking slot 421 so as to allow the first engaging device 41 to pivotally disengage from the second engaging device 42 for exposing the blade receiving cavity 33 to an exterior of the blade frame 30. Needless to mention, the user is then able to replace the cutter blade 10 conveniently.

It is worth mentioning that the first engaging device 41 further has a gripping slot 412 formed on the bottom supporting panel 312 of the first frame member 31 and adapted for a user to grip on it so as to allow the user to easily initiate the pivotal disengaging movement of the first engaging device 41 for ultimately disengaging the first frame member 31 from the second frame member 32.

Figure 2:
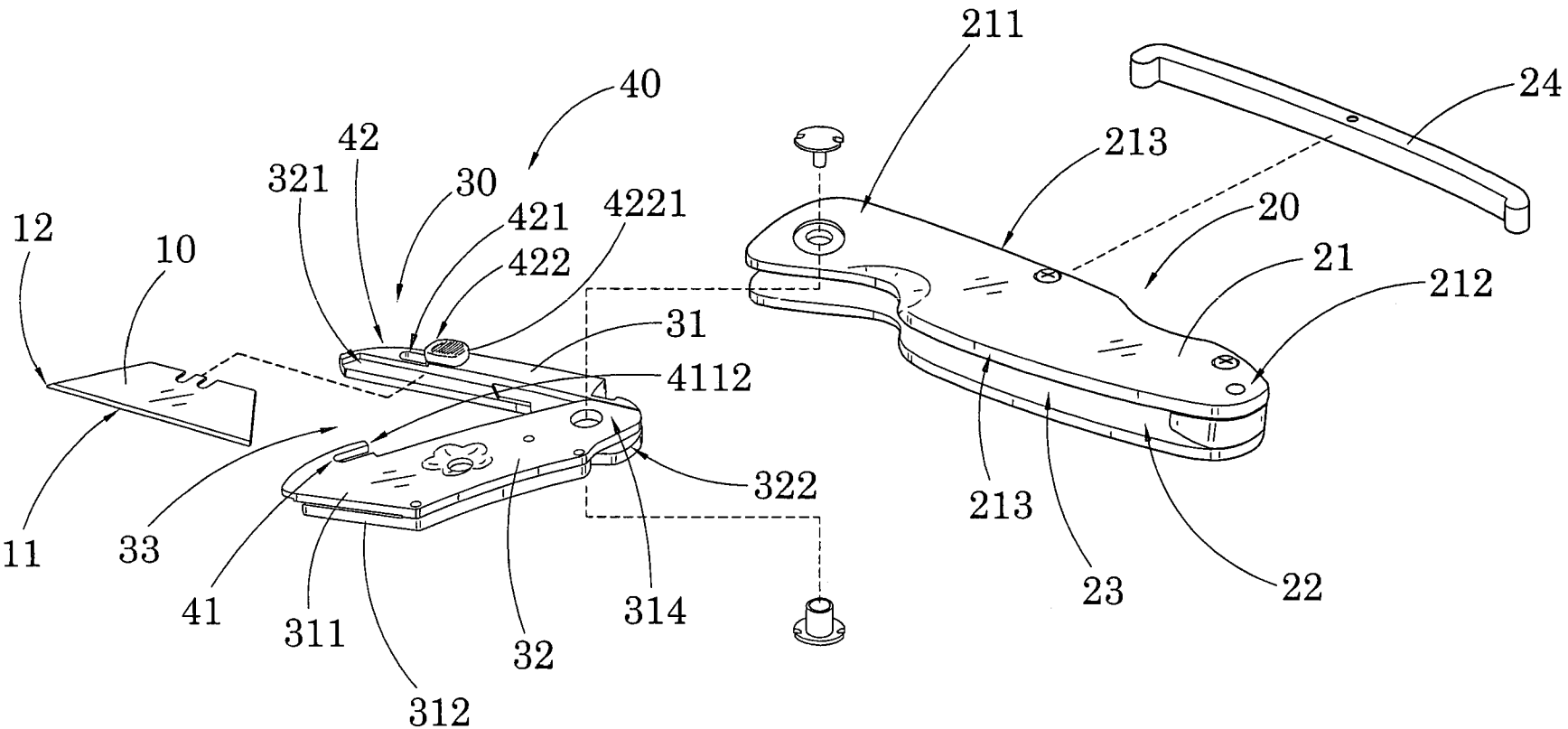
FIG. 2 is an exploded perspective view of the utility cutter according to the above preferred embodiment of the present invention.
Figure 3:
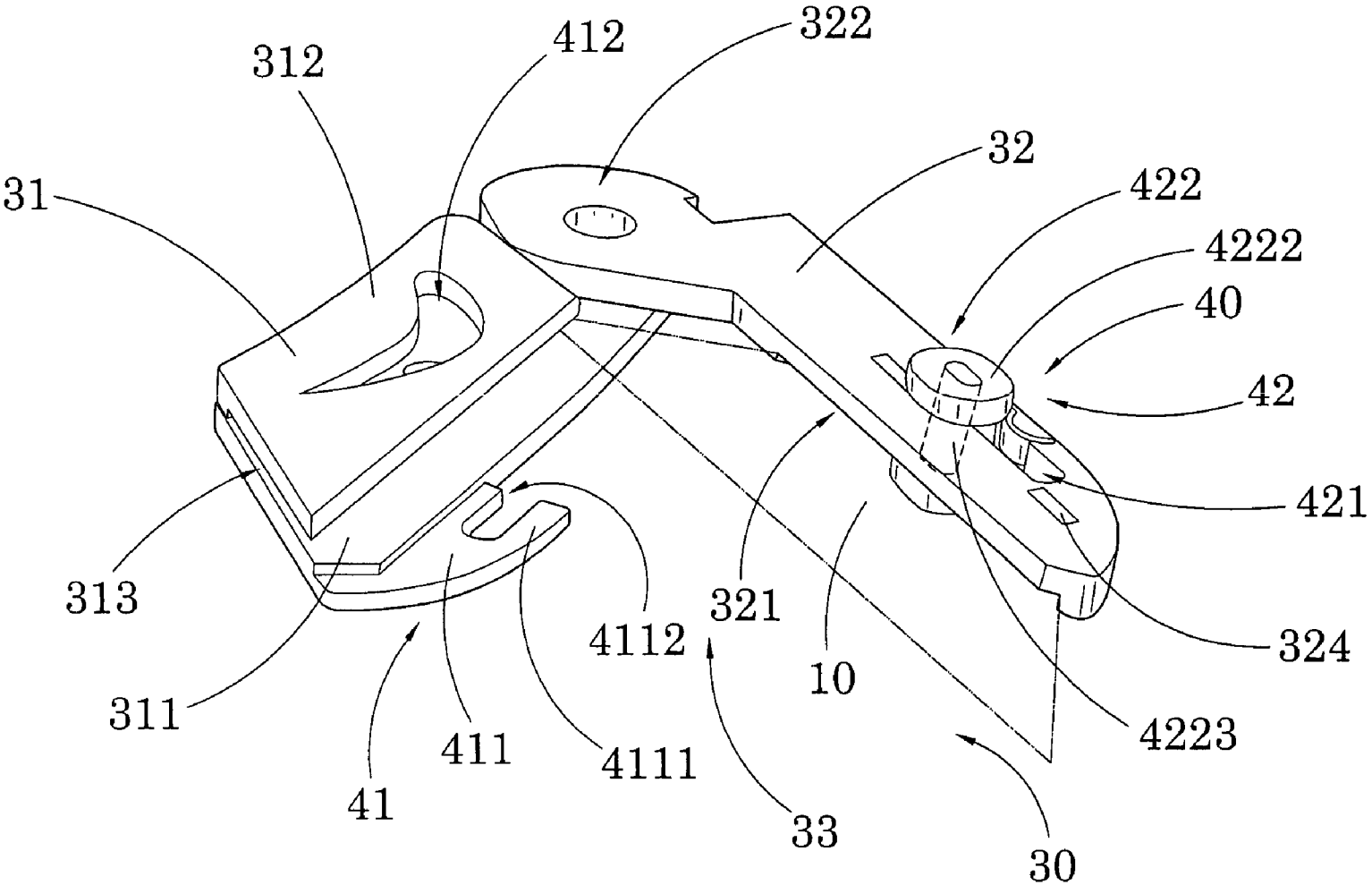
FIG. 3 is a schematic diagram of the utility cutter according to the above preferred embodiment of the present invention.
Figure 4A:
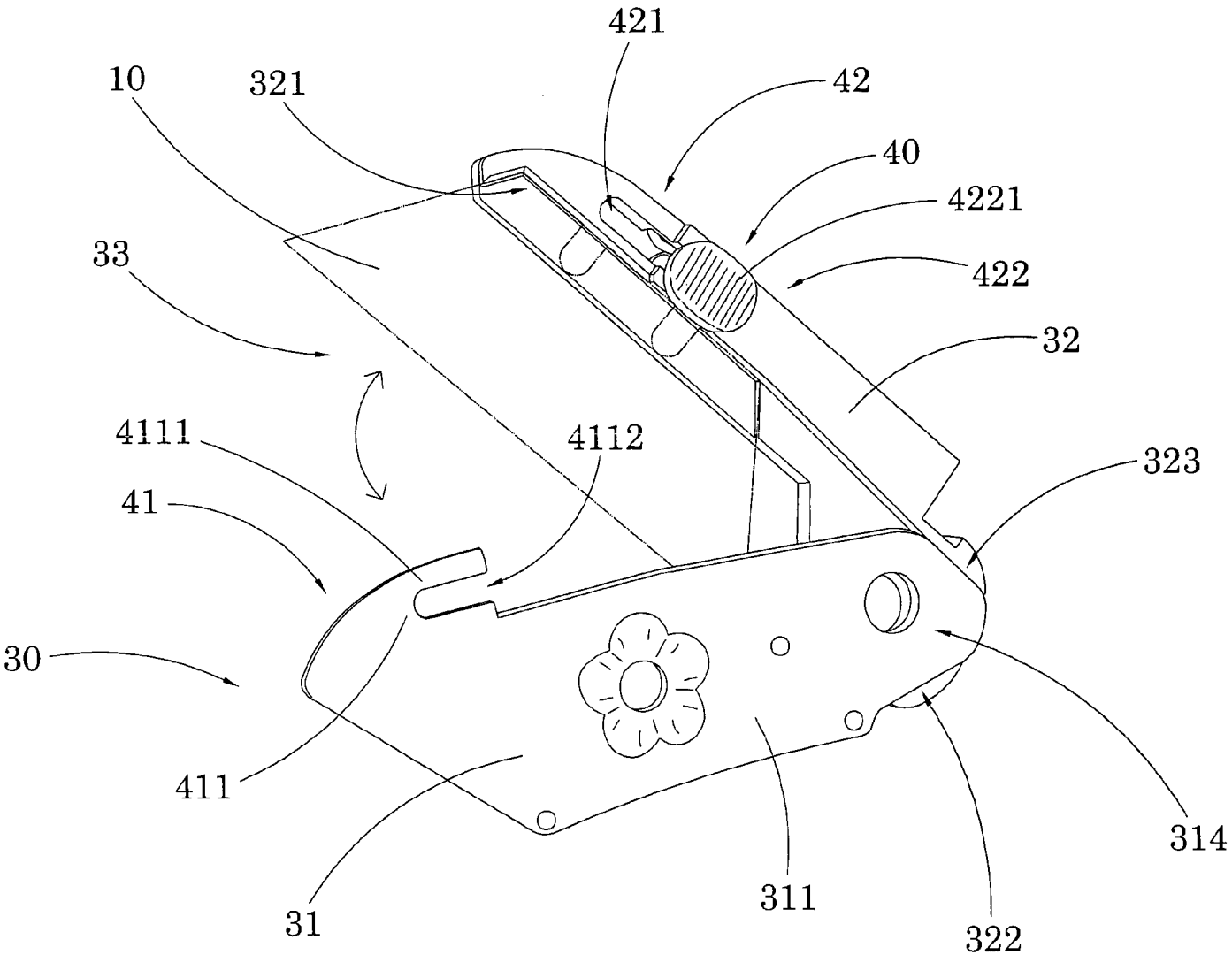
FIG. 4A and FIG. 4B are schematic diagrams of the utility cutter according to the above preferred embodiment of the present invention, illustrating replacement of the cutter blade.
Figure 4B:
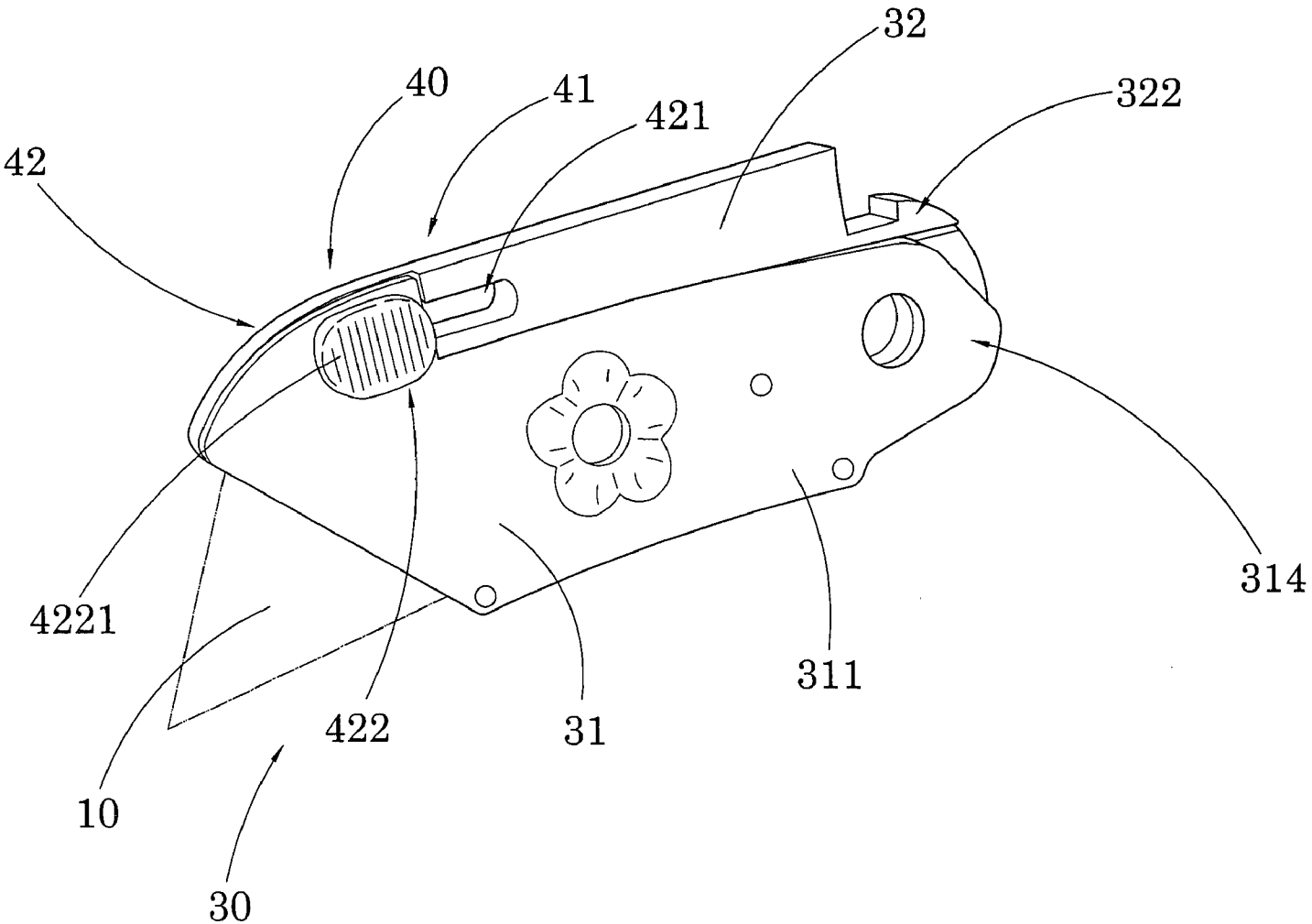

Referring to FIG. 2, FIG. 4A and FIG. 4B of the drawings, each of the first frame member 31 and the second frame member 32 has a first and a second rear pivot connecting portion 314, 322 for pivotally connecting with the elongated cutter handle 20 at the blade cavity 22. The second frame member 32 further has a blocker seat 323 formed at the second rear pivot connecting portion 322, in which the first rear pivot connecting portion 314 is also pivotally connected with the second rear pivot connecting portion 322 at the blocker seat 323 in such a manner that the blocker seat 323 is arranged to block a further pivotal movement of the first frame member 31 when it is disengaged from the second frame member 32. In other words, the blocker seat 323 restricts the extent to which the first frame member 31 is allowed to pivotally move for exposing the cutter blade 10.

According to the preferred embodiment of the present invention, a width of the upper supporting panel 311 is slightly larger than a width of the bottom supporting panel 312 of the first frame member 31 so that when the first frame member 31 pivotally moves to disengage from the second frame member 32, the cutter blade 10 is still adequately supported by the first and the second frame member 31, 32 for preventing unintended fall off of the cutter blade 10 even when the first and the second frame member 31, 32 disengage with each other. In order to further enhance a safety feature of the present invention, the first and the second frame member 31, 32 can be made of magnetic materials so as to normally exert a magnetic attractive force to the cutter blade 10 for retaining a position thereof within the blade receiving cavity 33.

According to the preferred embodiment of the present invention, the second frame member 32 further comprises a plurality of magnetic members 324 mounted thereon for providing the magnetic effect for holding the cutter blade 10 when it is to be replaced or a new cutter blade 10 is to be installed.

It is also worth mentioning that the cutter handle 20 further comprises a retention member 24 operatively provided on the handle housing 21 for engaging with the blade frame 30 when it is at the unfolded position so as to retain the blade frame thereat. Thus, a user has to actuate the retention member 24 in order to release the retention force exerted on the blade frame 30 for returning the blade frame to its unfolded position.

In light of the above, it is important to appreciate that a user of the present invention is able to replace the cutter blade 10 conveniently without substantial sliding movement thereof. In other words, the shortcomings as present in the above-mentioned conventional cutters are effectively resolved.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A utility cutter, comprising:

a cutter blade having a sharp edge and defining a sharp end thereat;

an elongated cutter handle which comprises an elongated handle housing having a front and a rear end portions and two side edges extending between said front and said rear end portion, and has a blade cavity formed in said handle housing, and an opening formed along one of said two side edges of said handle housing for communicating with said blade cavity;

a blade frame comprising a first and a second frame member pivotally mounted with each other to define a blade receiving cavity between said first and second frame members that said cutter blade is substantially retained at said blade receiving cavity, wherein said blade frame is pivotally mounted to said elongated cutter handle for folding between a folded position and an unfolded position, wherein in said folded position, said blade frame is pivotally folded to receive in said cutter handle to conceal said cutting blade, wherein in said unfolded position, said blade frame is pivotally unfolded to fully extend for exposing said sharp end of said cutter blade to an exterior of said blade frame, wherein said blade frame is adapted to be folded and received into said blade cavity via said opening when said blade frame is in said folded position, wherein said first frame member comprises an upper supporting panel, and a bottom supporting panel having a longitudinal portion and a transverse potion to define a L-shaped cross section, wherein said transverse portion of said bottom supporting panel is integrally connected with an outer side edge portion of said upper supporting panel to form a supporting groove between said first and said second frame member as partially defining said blade receiving cavity of said blade frame, such that when said first and said second frame member are interlocked with each other, said cutter blade is arranged to receive in said supporting groove, wherein said second frame member, which is pivotally extended from said handle housing of said cutter handle, has a L-shaped retaining groove longitudinally extended along an inner side edge of said second frame member to align with said supporting groove of said first frame member so that when said first frame member is interlocked with said second frame member, said supporting groove is communicated with said retaining groove to form said blade receiving cavity, wherein said cutter blade is fittedly received into said blade receiving cavity with two side edges substantially biasing against said corresponding side edges of said supporting groove and said retaining groove respectively; and a blade replacement arrangement operatively coupled with said first and said second frame member for normally locking said first and said second frame member with each other to securely lock up said cutter blade in said blade receiving cavity, wherein when said blade frame is in said unfolded position, said blade replacement arrangement is adapted to unlock said first frame member from said second frame member so as to allow said first frame member to disengage with said second frame member for exposing said blade receiving cavity to an exterior of said blade frame, such that said cutter blade is capable of being conveniently and safely replaced at said blade receiving cavity without sliding movement of said cutter blade, wherein said blade replacement arrangement comprises a first and a second engaging device provided on said first and said second frame member respectively for detachably engaging said first frame member with said second frame member, wherein said first engaging device comprises a locking latch member, having a U-shaped locker latch, integrally and sidewardly extended from a front end portion of said upper supporting panel of said first frame member for detachably engaging with said second engaging device, wherein said U-shaped locker latch defines a locker channel at said locking latch member, wherein said second engaging device contains a locking slot longitudinally formed on said second frame member, and comprises a locking actuator slidably mounted on said locking slot for detachably engaging with said locking latch member of said first engaging device, wherein said locking actuator comprises a top and a bottom pusher button movably provided on a top and a bottom side of said locking slot respectively, and a locker pin extended between said top and said bottom pusher buttons for slidably moving within said locking slot.

2. The utility cutter, as recited in claim 1, wherein said locker channel is arranged to align with said locking slot such that when said first engaging device is engaged with said second engaging device, said locking slot and said locker channel overlap with each other for allowing said locking actuator to slide along said locker channel and said locking slot for said blade replacement arrangement to operate between a locked mode and an unlocked mode, wherein in the locked mode, said first engaging device is arranged to pivotally move to engage with said second engaging device and that said locker pin is slidably driven to move frontwardly along said locking slot to block a pivotal disengagement between said first engaging device and said second engaging device, wherein in said unlocked mode, said locker pin is driven to move rearwardly along said locking slot so as to allow said first engaging device to pivotally disengage from said second engaging device for exposing said blade receiving cavity for replacement of said cutter blade.

3. The utility cutter, as recited in claim 2, wherein each of said first frame member and said second frame member has first and second rear pivot connecting portion for pivotally connecting with said elongated cutter handle at said blade cavity, wherein said second frame member further has a blocker seat formed at said second rear pivot connecting portion, in such a manner that said blocker seat is arranged to block a further pivotal movement of said first frame member when said first frame member is disengaged from said second frame member, so as to restricts an extent to which said first frame member is allowed to pivotally move for exposing said cutter blade.

4. The utility cutter, as recited in claim 3, wherein a width of said upper supporting panel is slightly larger than a width of said bottom supporting panel of said first frame member so that when said first frame member pivotally moves to disengage from said second frame member, said cutter blade is still adequately retained by said first and the second frame member for preventing unintended fall off of said cutter blade even when said first and said second frame member disengage with each other.

5. The utility cutter, as recited in claim 4, wherein said second frame member further comprises a magnetic member mounted thereon for normally exerting a magnetic attractive force to said cutter blade for retaining a position thereof within said blade receiving cavity, and for guiding replacement of said cutter blade.

* * * * *